United States Patent [19]

Nagengast et al.

[11] Patent Number: 5,003,446

[45] Date of Patent: Mar. 26, 1991

[54] COMPOSITE HEADLAMP VENT DEVICE

[75] Inventors: William E. Nagengast; James S. Mellinger; David R. McMahan, all of Anderson, Ind.

[73] Assignee: General Motors Corporation, Detroit, Mich.

[21] Appl. No.: 575,757

[22] Filed: Aug. 31, 1990

[51] Int. Cl.[5] ..... F21V 29/00

[52] U.S. Cl. ..... 362/294; 362/61; 362/345

[58] Field of Search ..... 362/61, 294, 345, 373, 362/310

[56] References Cited

U.S. PATENT DOCUMENTS

| | | | |
|---|---|---|---|
| 4,747,032 | 5/1988 | Weber | 362/345 X |
| 4,849,865 | 7/1989 | Van Duyn | 362/345 X |
| 4,937,710 | 6/1990 | Hurley et al. | 362/294 X |

*Primary Examiner*—Stephen F. Husar

*Attorney, Agent, or Firm*—Edward J. Biskup

[57] ABSTRACT

A headlamp having a mounting hole formed in the curved outer surface of a reflector housing along an axis which is generally parallel to the optical axis of the housing and which is adapted to receive a push-in type vent device formed with a skirt having a configuration that provides a good sealing relationship with the curved outer surface of the housing.

12 Claims, 2 Drawing Sheets

COMPOSITE HEADLAMP VENT DEVICE

This invention concerns headlamps of the replaceable bulb type and more particularly relates to a vent device and a ventilation system for such headlamps.

Copending U.S. patent application Ser. No. 182,692 entitled "Ventilation System for Headlamp", filed on Apr. 18, 1988 in the name of Hurley et al and assigned to the assignee of this invention, now U.S. Pat. No. 4,937,710, discloses a vent device that can be mounted in a reflector housing and provides a labyrinth type passage through which air can flow into and out of the interior of the housing for providing ventilation thereof. The vent device includes a circular base formed with a circular skirt and an upstanding plug is formed integrally with the base at a central point thereof. A wall in the form of a spiral is connected at its inner end to the plug and is connected at its outer end to the skirt and cooperates with the exterior surface of the housing to form a spiraling passage through which the ventilating air can flow into and out of the housing.

Although the vent device described above can provide ventilation of a composite headlamp, it is limited in use to a surface which is planar in configuration. Accordingly, if placed on a curved surface, such as usually provided on the rear portion of a parabolic reflector, the desired sealing of the vent device as well as proper ventilation of the headlamp would not be achieved.

The present invention is directed to a vent device which has certain similarities to the above mentioned vent device but differs therefrom in that it is designed and constructed for use on a curved surface of a reflector housing. More specifically, the vent device according to the present invention is adapted to be mounted in a hole located in a curved outer surface of a lamp housing. In the preferred form, the vent device is made from an elastomeric material and comprises a generally flat base having a skirt the front portion of which terminates with a curved sealing edge. The rear portion of the skirt is generally normal to the base and terminates with a curved sealing edge which merges with the sealing edge of the front portion of the skirt. A barb-type plug member has one end integrally formed with the base and extends at an angle therefrom towards the front portion of the skirt. The other end of the plug member is formed with a head which is larger in diameter then the diameter of the hole in the housing. A slot is formed in the plug member along the length thereof and an opening is provided in the base. The arrangement is such that when the head of the plug member is inserted into the hole in the housing, the head compresses radially inwardly for securing the vent device to the housing and the sealing edge of the front and rear portions of the skirt sealingly engage the curve outer surface of the lamp housing so as to allow air to flow via the slot in the plug member and the opening in the base into and out of the interior of the lamp housing to vent the latter.

The objects of the present invention are to provide a new and improved vent device for a lamp that can be sealingly located in a hole provided on a curved surface of the reflector housing; to provide a new and improved vent device for a lamp having a hole formed in the curved surface of a reflector housing along an axis which is generally parallel to the optical axis of the housing and which is adapted to receive a push-in type vent device formed with a skirt the sealing edge of which is curved in configuration to conform to and allow a good sealing relationship with the curved surface of the housing; to provide a new and improved ventilation system for a headlamp in which the curved outer surface of the reflector supports a vent device formed from an elastomeric material and in which the vent device has a base section integrally formed with a depending skirt and a barb-type plug member the longitudinal axis of which is inclined relative to the plane of the base section so as to facilitate the insertion of the plug member into a mounting hole provided in the curved outer surface of the reflector along an axis that is substantially parallel to the optical axis of the reflector; and to provide a new and improved vent device for a headlamp that includes a base section the inner surface of which is integrally formed with an angled barb-type plug member and in which the outer surface of the base section is integrally formed with an enlargement for facilitating the manual insertion of the plug member into an accommodating hole in the curved outer surface of the reflector.

Other objects and advantages of the present invention will be more apparent from the following detailed description of the invention taken with the drawings in which.

Figure 1:
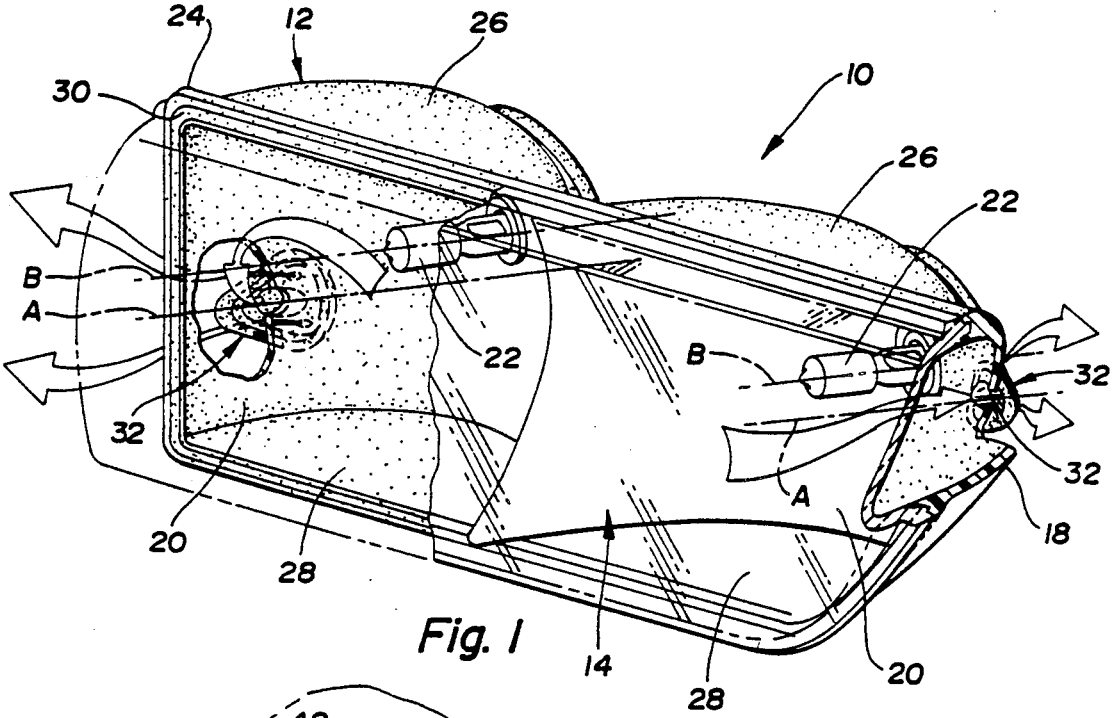
FIG. 1 is a perspective view of a motor vehicle headlamp incorporating a vent device made in accordance with the present invention.

Referring now to the drawings and more particularly FIG. 1 thereof, a replaceable bulb composite type headlamp 10 is shown of the rectangular type comprising a reflector housing 12 made of a plastic material and having the front face thereof closed by a glass or plastic lens 14. In this instance, the reflector housing 12 includes a pair of side-by-side cavities each of which is partially formed by a parabolic backwall defined by compound curved outer surface 18 and a parabolic curved inner surface 20 the latter of which is aluminized so as to provide the usual parabolic reflecting surface for projecting a forwardly directed beam of light originating at a light source such as a replaceable bulb 22 located in the center of the associated cavity.

More specifically, the front face of the reflector housing 12 is defined by a rectangular flange integrally formed with and surrounding the open end of the cavities. A horizontally orientated top wall 26 and a horizontally orientated bottom wall 28 are integrally formed with the parabolic backwall and together with the flange 24 define each of the cavities of the reflector housing 12. As is conventional, a continuous channel 30 of uniform depth is formed in the flange 24 of the reflector housing 12 around the entire margin of the front face thereof. The lens 14 has a flange located within the channel 30 and is bonded to the front face of the reflector housing 12 by an adhesive such as butyl rubber which also serves as a sealant.

Figure 2:
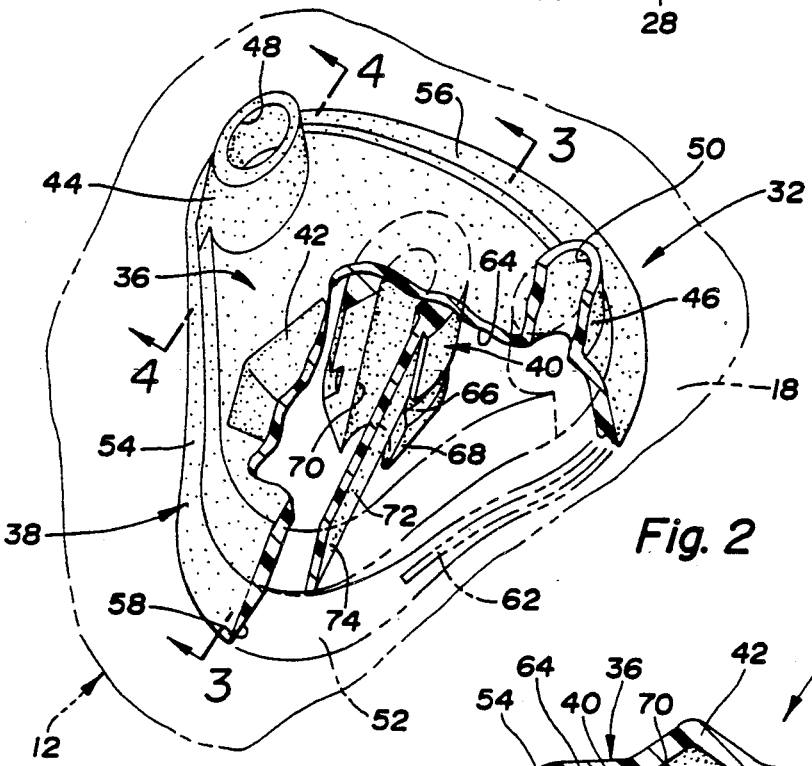
FIG. 2 is a partially sectioned enlarged view of one of the vent devices incorporated in the headlamp of FIG. 1.
Figure 3:
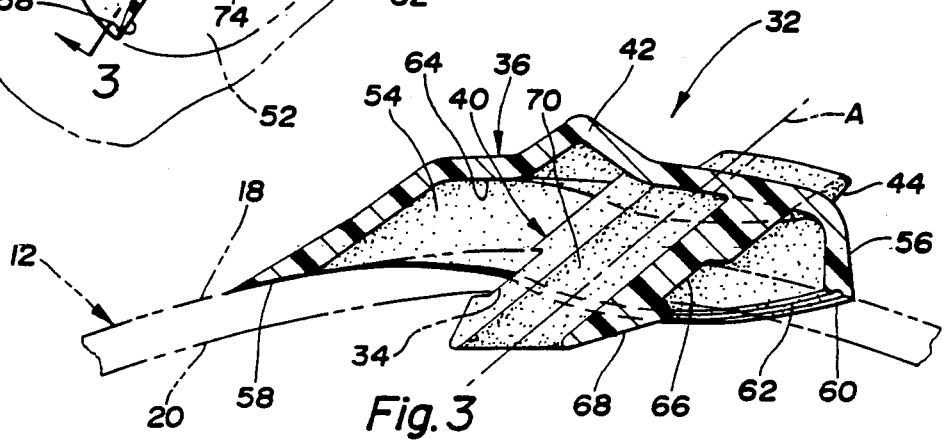
FIG. 3 is a sectional view of the vent device taken on line 3—3 of FIG. 2.
Figure 4:
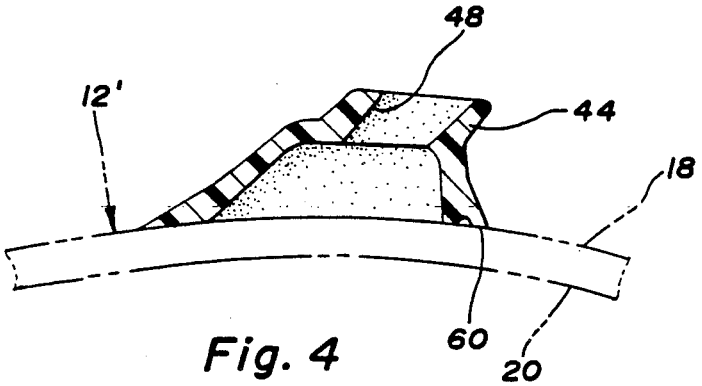
FIG. 4 is a sectional view of the vent device taken on line 4—4 of FIG. 2.

In order to vent the headlamp 10 so as to prevent moisture from collecting in the interior thereof, the headlamp 10 is provided with a ventilation system which, as seen in FIG. 1, includes a pair of identical vent devices made according to the present invention and each of which is identified by the reference numeral 32. As seen in FIGS. 1–3, each of the vent devices 32 is supported within a mounting hole 34 formed in the outer surface 18 of the associated parabolic backwall of the reflector housing 12 at the outer end thereof. The mounting hole 34 is circular but is formed in the the parabolic backwall of the reflector housing 12 so that the center longitudinal axis "A" thereof is angled relative to the outer surface 18 of the backwall as seen in FIG. 3. In the preferred form, the axis "A" is aligned with the "die pull" axis of the reflector housing 12 which results in the axis being generally parallel to the optical axis "B" of the reflector housing 12. This allows the tooling for the reflector housing 12 to be simplified and eliminates secondary drilling operations.

As best seen in FIGS. 1–3, the vent device 32 is a molded elastomeric part shown located in the mounting hole 34 formed in the backwall of the reflector housing 12. The vent device 32 generally comprises a base 36, a skirt 38 which completely surrounds the base 36, and a barb type plug member 40 which extends outwardly at an angle from the base 36.

As seen in FIG. 2, the base 36 is generally triangularly shaped and is basically flat or planar when viewed in cross section in FIG. 3 except for an enlargement 42 formed on the upper surface of the base 36. A pair of towers 44 and 46 located at the rear corners of the base respectively surround cylindrical holes 48 and 50 in the base 36 that are provided for purposes to be explained hereinafter.

The skirt 38 is integrally formed with the base 36 and includes a front portion consisting of a pair of diverging generally straight side sections 52 and 54 and a curved rear portion 56 which extends between the towers 44 and 46. Each side section 52 and 54 of the front portion is angled outwardly downwardly relative to the base as seen in FIG. 3 and terminates with a sealing edge 58 which, as seen in FIG. 3, is spherical in configuration so as conform in shape to the outer surface 18 of the reflector housing 12 and thereby provide good sealing contact therewith. The rear portion 56 of the skirt 38 extends downwardly substantially perpendicular to the base 36 and also terminates with a spherically curved sealing edge 60 that conforms to the shape of the outer surface 18. It will be noted that the sealing edges of both the side sections 52 and 54 and the rear portion 56 have a continuous channel 62 formed therein that extends along the entire length of the rear portion 56 as well as along substantially the entire length of the spherically shaped sealing edge 58 of each side section 52 and 54 of the front portion of the skirt 38. The channel 62 serves to divide each of the sealing edges into a inner and outer seal members for further insuring good sealing contact with the curved outer surface 18 of the reflector housing 12.

The plug member 40 is integrally formed with the inner surface 64 of the base 36 and extends at an angle therefrom, as seen in FIG. 3, that assures that the sealing edges 58 and 60 of the front portion and the rear portion of the skirt 38 properly seal with the curved outer surface 18 of the reflector housing 12. The outer surface of the plug member 40 is generally cylindrical in configuration and has a circular ring-like retainer groove 66 formed in the outer peripheral surface thereof that is designed to snugly accomodate the wall thickness of the backwall. The groove 66 is located in a plane which is inclined to the longitudinal axis of the plug member 40 and, below the groove 66, a tapered head 68 is provided the major diameter of which is greater than the diameter of the mounting hole 34 in the reflector housing 12. A slot 70 is formed in the plug member 40 along the length thereof that opens to the interior of the vent device 32 and provides communication between the holes 48 and 50 in the base 36 and the interior of the reflector housing 12 as will be more fully explained hereinafter. A rib 72 is integrally formed with the inner surface 64 of the base 36 and extends downwardly therefrom. As best seen in FIG. 2, the rib 72 starts at the plug member 40 to one side of the slot 70 and extends forwardly towards the area where the side sections 52 and 54 of the front portion of the skirt 38 intersect. The lower edge 74 of the rib 72 merges with the sealing edge 58 of the side section 52 of the skirt 38 and also is curved so as to conform to the curved outer surface 18 of the reflector housing 12. The rib 72 serves as a stop for preventing the plug member 40 from being forcibly inserted into the accomodating mounting hole 34 beyond the upper edge of the groove 66.

Thus, as seen in FIG. 1, when the vent device 32 is installed into each of the mounting holes 34 in the reflector housing 12, air can flow between the two vent devices 32 throughout the interior of the headlamp for ventilation purposes. Also, installation of each of the vent devices 32 is a simple matter requiring initially aligning the plug member 40 with the mounting hole 34 and afterwards applying thumb pressure on the enlargement 42 formed with the base 36 and along an axis parallel to the longitudinal axis of the plug member 40. The thumb pressure will cause the tapered head 68 of the plug member 40 to compress radially inwardly and move into the mounting hole 34 until it expands again and assumes the position shown in FIG. 3 at which point the groove 66 accommodates the full thickness of the backwall. At the same time the lower edge of the rib 74 prevents further insertion of the plug member 40 into the mounting hole 34 and the sealing edges 58 and 60 of the front and rear portions of the skirt 38 make sealing contact with the curved outer surface 18 of the reflector housing 12. In the installed position of the vent device 32, air is able to flow into and out of the interior of the headlamp 10 via the slot 70 in the plug member 40, the sealed triangular chamber defined by the interior of the vent device 32 and the outer curved surface 18 of the backwall, and the holes 48 and 50 of the towers 44 and 46. Also, the towers 44 and 46 prevent "splash-in" of water that can occur during vehicle travel or while the vehicle is in a car wash.

Figure 5:
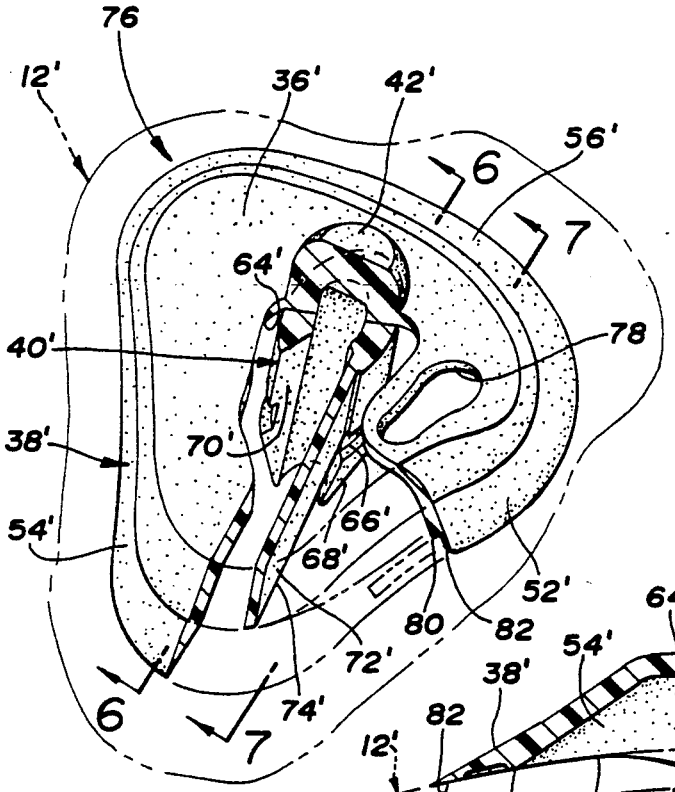
FIG. 5 is a view similar to that seen in FIG. 2 of a modified form of the vent device according to the present invention.
Figure 6:
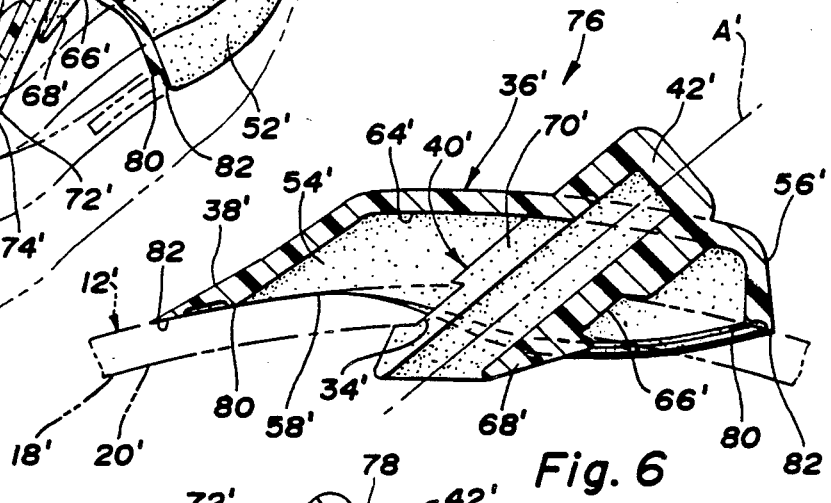
FIG. 6 is a sectional view taken on line 6—6 of FIG. 5.
Figure 7:
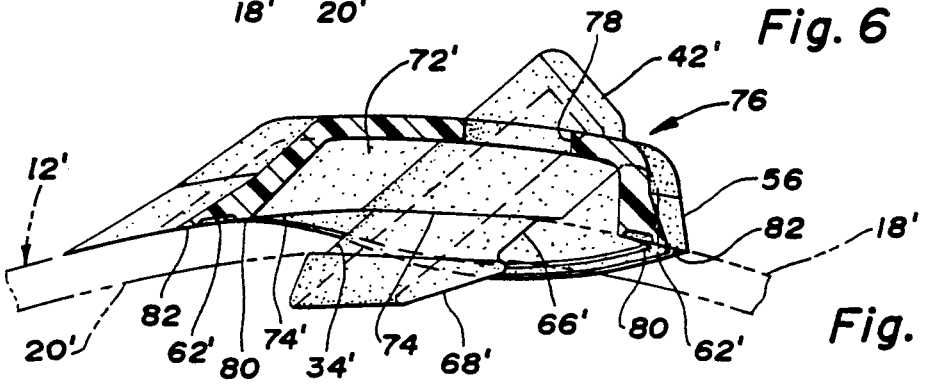
FIG. 7 is a sectional view taken on line 7—7 of FIG. 5.

FIGS. 5–7 show a modified form of the vent device 32 seen in FIGS. 1–4, which in this instance is identified by reference numeral 76. It will be noted that all parts of the vent device 76 that correspond to the parts of the vent device 32 are identified by same reference numerals but primed.

As seen in FIGS. 5–7, the vent device 76 comprises a triangularly shaped base 36' which is integrally formed with and completely surrounded by a skirt 38' having a front portion defined by sections 52' and 54' a rear portion 56'. The base 36'is also planar, but rather than having a pair of towers 44 and 46 defining a pair of holes for air flow as provided in vent device 32, the base 36' instead is formed with a single generally kidney-shaped hole 78. The sealing edge of the front and rear portions of the skirt 38' are each also curved for conformance with the curved outer surface 18' of the reflector housing 12' and are formed with inner and outer sealing members 80 and 82 for providing a continuous dual seal between the vent device 76 and the outer curved 18' surface of the reflector housing 12'. The plug member 40' is essentially the same as the plug member 40 of the vent device 32. However, the enlargement 42' on the outer surface of the base 36' is located in axial alignment with the plug member 40' so that thumb pressure during installation of the vent device 76 in the accomodating mounting hole 34' permits the insertion force to be applied in direct axial alignment with the plug member 40'.

When the vent device 76 is installed in the mounting hole 34' formed in the backwall of the reflector housing 12' as seen in FIG. 6, the air flow similarly moves into and out of the interior of the headlamp 10' via the slot 70' in the plug member 40', the chamber defined by the outer curved surface 18' of the backwall and the inner surface 64' of the base 36' and front and rear portions thereof, and the hole 78 in the base 36'. Although not shown, a tower can surround the hole 78 and serve the same purpose as the towers 44 and 46 of the vent device 32.

Various changes and modifications can be made in the above described vent arrangement without departing from the spirit of the invention. Such changes and modifications are contemplated by the inventors, and they do not wish to be limited except by the scope of the appended claims.

The embodiments of the invention in which an exclusive property or privilege is claimed are defined as follows:

1. A vent device for mounting in a hole located in a curved outer surface of a lamp housing, said vent device being made from an elastomeric material and comprising a base having a skirt which terminates with a curved sealing edge complementary to said curved outer surface, a plug member having one end integral with said base and extending at an angle therefrom, the other end of said plug member being formed with a head which is larger in diameter then the diameter of said hole in said housing, a passage formed in said plug member along the length thereof, and an opening provided in said base, the arrangement being such that when said head of said plug member is inserted into said hole in said housing, the head compresses radially inwardly for securing the vent device to said housing and said sealing edge of said skirt sealingly engages the curved outer surface of said lamp housing so as to allow air to flow via said passage in said plug member and said opening in said base into and out of the interior of said lamp housing to vent the latter.

2. In combination with a lamp having a reflector housing the front portion of which is closed by a lens, said reflector housing having a backwall defined by an inner curved reflecting surface and an outer curved support surface, a light source located at the focal point of said curved reflecting surface so as to allow said reflecting surface to project light rays forwardly towards said lens parallel to the optical axis of said reflecting surface, a mounting hole formed in said wall, a vent device located in said mounting hole, said vent device being made from an elastomeric material and comprising a base having a skirt which terminates with a curved sealing edge complementary to said outer curved support surface, a plug member having one end integral with said base and extending at an angle therefrom, the other end of said plug member being formed with a head which is larger in diameter then the diameter of said hole in said housing, a passage formed in said plug member along the length thereof, and an opening provided in said base, the arrangement being such that when said head of said plug member is inserted into said mounting hole in said housing, the head compresses radially inwardly for frictionally securing the vent device to said housing and said sealing edge of said skirt sealingly engages the curved outer surface of said lamp housing so as to allow air to flow via said passage in said plug member and said opening in said base into and out of the interior of said lamp housing to vent the latter.

3. The combination of claim 2 wherein said opening in said base is surrounded by an upstanding tower.

4. The combination of claim 2 wherein the outer surface of said base is provided with an enlargement to facilitate manual insertion of said plug member into said mounting hole.

5. The combination of claim 2 wherein stop means are operatively associated with said plug member for limiting the extent of insertion of said plug member into said mounting hole.

6. The combination of claim 4 wherein said enlargement is in axial alignment with the longitudinal axis of said plug member.

7. The combination of claim 3 wherein said base is triangular in configuration and has said opening located at two corners of said base.

8. The combination of claim 4 wherein said enlargement is offset relative to the longitudinal axis of said plug member.

9. The combination of claim 5 wherein said stop means consists of a rib integrally formed with and depending from the inner surface of said base.

10. The combination of claim 9 wherein the free edge of said rib serves as said stop and is curved so as to conform to said outer curved support surface of said housing.

11. The combination of claim 2 wherein said sealing edge is provided with an inner seal member and an outer seal member.

12. In combination with a lamp having a reflector housing the front portion of which is closed by a lens, said reflector housing having a wall defined by an inner curved reflecting surface and an outer curved support surface, a light source located at the focal point of said curved reflecting surface so as to allow said reflecting surface to project light rays forwardly towards said lens parallel to the optical axis of said reflecting surface, a mounting hole formed in said wall along an axis substantially parallel to said optical axis, a vent device located in said mounting hole, said vent device being made from an elastomeric material and comprising a base having a skirt the front portion and rear portion of which terminates with a curved sealing edge complementary to said outer curved support surface, the rear portion of said skirt being generally normal to said base and terminating with a sealing edge which merges with said sealing edge of said front portion of said skirt, a plug member having one end integral with said base and extending at an angle therefrom towards said front portion of said skirt, the other end of said plug member being formed with a head which is larger in diameter then the diameter of said hole in said housing, a passage formed in said plug member along the length thereof, and an opening provided in said base, the arrangement being such that when said head of said plug member is inserted into said mounting hole in said housing, the head compresses radially inwardly for frictionally securing the vent device to said housing and said sealing edge of said front portion and said rear portion of said skirt sealingly engage the curved outer surface of said housing so as to allow air to flow via said passage in said plug member and said opening in said base into and out of the interior of said housing to vent the latter.

* * * * *